US012558717B2

(12) United States Patent
Onagi et al.

(10) Patent No.: US 12,558,717 B2
(45) Date of Patent: Feb. 24, 2026

(54) BENDING SYSTEM, AND DIVIDED TOOL ARRANGEMENT METHOD

(71) Applicant: AMADA CO., LTD., Kanagawa (JP)

(72) Inventors: Yousuke Onagi, Kanagawa (JP); Kazuho Mochida, Kanagawa (JP); Katsumi Watanabe, Kanagawa (JP)

(73) Assignee: AMADA CO., LTD., Kanagawa (JP)

( * ) Notice: Subject to any disclaimer, the term of this patent is extended or adjusted under 35 U.S.C. 154(b) by 349 days.

(21) Appl. No.: 18/287,323

(22) PCT Filed: Apr. 19, 2022

(86) PCT No.: PCT/JP2022/018100
§ 371 (c)(1),
(2) Date: Oct. 18, 2023

(87) PCT Pub. No.: WO2022/224943
PCT Pub. Date: Oct. 27, 2022

(65) Prior Publication Data

US 2024/0375167 A1 Nov. 14, 2024

(30) Foreign Application Priority Data

Apr. 21, 2021 (JP) ..... 2021-072018
Apr. 11, 2022 (JP) ..... 2022-065127

(51) Int. Cl.
*B21D 5/00* (2006.01)
*B21D 5/02* (2006.01)

(52) U.S. Cl.
CPC ..... *B21D 5/004* (2013.01); *B21D 5/0254* (2013.01)

(58) Field of Classification Search
CPC ..... B21D 5/002; B21D 5/004; B21D 5/0218; B21D 5/0227; B21D 5/0236;
(Continued)

(56) References Cited

U.S. PATENT DOCUMENTS 10,486,213 B2 * 11/2019 Sato ..... B21D 37/145
2007/0271987 A1 * 11/2007 Shimizu ..... B21D 37/145 72/417

(Continued)

FOREIGN PATENT DOCUMENTS

JP 2004358533 A * 12/2004
JP 5947861 B2 6/2016

(Continued)

OTHER PUBLICATIONS

International Search Report for corresponding Application No. PCT/JP2022/018100, mailed Jul. 19, 2022.

(Continued)

*Primary Examiner* — Jared O Brown
(74) *Attorney, Agent, or Firm* — Renner, Otto, Boisselle & Sklar, LLP

(57) ABSTRACT

A gathering operation includes a restraint operation of moving forward a left lower tool retention member so as to restrain a reference lower tool with the left lower tool retention member, an inserting operation of moving forward a right lower tool retention member so as to insert the right lower tool retention member into an insertion hole of a target lower tool, and an execution operation of moving the left and right lower tool retention members along a left-right direction so as to come close with each other. If a failure of the inserting operation is determined, a control device performs a retry operation of moving forward the right lower tool retention member again so as to insert the right lower tool retention member into the insertion hole (141) of the target lower tool after moving backward the left lower tool retention member.

13 Claims, 9 Drawing Sheets

(58) Field of Classification Search
CPC ..... B21D 5/0254; B21D 5/02–047; B21D 37/04; B21D 37/14; B21D 37/145; B30B 15/026; B30B 15/028
See application file for complete search history.

(56) References Cited

U.S. PATENT DOCUMENTS

| | | | | |
|---|---|---|---|---|
| 2017/0297073 | A1 | 10/2017 | Sato | |
| 2018/0236518 | A1* | 8/2018 | Sato | B21D 5/0218 |
| 2020/0114407 | A1* | 4/2020 | Fabris | B21D 5/0254 |
| 2021/0245222 | A1* | 8/2021 | Watanabe | B21D 5/0254 |

FOREIGN PATENT DOCUMENTS

| | | | | |
|---|---|---|---|---|
| JP | 5970339 | B2 * | 8/2016 | B21D 5/0209 |
| JP | 2019122972 | A * | 7/2019 | |

OTHER PUBLICATIONS

Written Opinion for corresponding Application No. PCT/JP2022/018100, mailed Jul. 19, 2022.
Extended European Search Report for corresponding EP Application No. 22791714.3 dated Sep. 3, 2024.

* cited by examiner

BENDING SYSTEM, AND DIVIDED TOOL ARRANGEMENT METHOD

TECHNICAL FIELD

The present disclosure relates to a bending system and a divided tool arrangement method.

BACKGROUND ART

A bending system includes a press brake that bends a workpiece, and the press brake includes a table and a tool holder that is provided to the table and holds a tool. Further, the bending system includes a tool rack that is disposed to a side of the press brake and stores a plurality of the tools. The tool rack includes a plurality of stockers that hold the tools, and a selected arbitrary stocker is configured to be able to be positioned at a change position at which tool change is performed. Furthermore, the bending system includes left and right tool change units that transport the tool between the tool holder and the stocker positioned at the change position so as to arrange the tool at a desired position of the tool holder. Each of the tool change units includes a tool retention member capable of being inserted into and removed from an insertion hole provided to the tool (see Patent Literature 1).

CITATION LIST

Patent Literature

Patent Literature 1: Japanese Patent No. 5947861

SUMMARY

Now, when a tool stage in which the plurality of the tools are combined is arranged in the tool holder, a gathering operation is performed to gather the plurality of the tools so that there are no gaps between the tools. This gathering operation is performed by inserting the tool retention member into the insertion hole of the tool. However, if a failure of an inserting operation of inserting the tool retention member into the insertion hole is determined, an alarm is generated. Then, there is an inconvenience that the gathering operation is interrupted.

A bending system according to one aspect of the present disclosure includes a press brake in which a plurality of tools are arranged along a left-right direction in a tool holder provided to a table, a first moving body and a second moving body each including a tool retention member capable of being inserted into and removed from an insertion hole provided to the tool by moving forward and moving backward along a front-back direction, and provided on a rear surface side or a front surface side of the table so as to be movable in the left-right direction, and a control device configured to control each of the first and second moving bodies so as to perform a gathering operation of gathering the plurality of tools so that there are no gaps between the tools. The gathering operation includes a restraint operation of moving forward a first tool retention member of the first moving body so as to restrain a reference tool positioned at one end of the plurality of tools with the first tool retention member, an inserting operation of moving forward a second tool retention member of the second moving body so as to insert the second tool retention member into the insertion hole of a target tool selected from among remaining tools, which exclude the reference tool, of the plurality of tools, and an execution operation of moving the first and second moving bodies along the left-right direction so as to come close to each other so that the tools from the reference tool to the target tool are gathered. When the failure of the inserting operation is determined, the control device performs a retry operation of moving forward the second tool retention member again to insert the second tool retention member into the insertion hole of the target tool after moving backward the first tool retention member to release the restraint operation.

According to the bending system of one aspect of the present disclosure, when the failure of the inserting operation is determined, the retry operation is performed. This retry operation is performed in a state in which the reference tool is released from restraint by moving backward the first tool retention member. By releasing the reference tool from the restraint, a margin is generated for the reference tool to slightly move, and the reference tool to the target tool can move slightly as a whole. Thanks to this, in the retry operation, the second tool retention member can be easily inserted into the target tool. As a result, even if the inserting operation fails once, if the second tool retention member can be inserted into the target tool by the retry operation, the gathering operation can be continued without generating the alarm.

According to one aspect of the present disclosure, it is possible to suppress an occurrence of interruption of the gathering operation.

DESCRIPTION OF EMBODIMENTS

A bending system and a divided tool arranging method according to embodiments of the present disclosure will be described below with reference to the drawings.

First Embodiment

Figure 1:
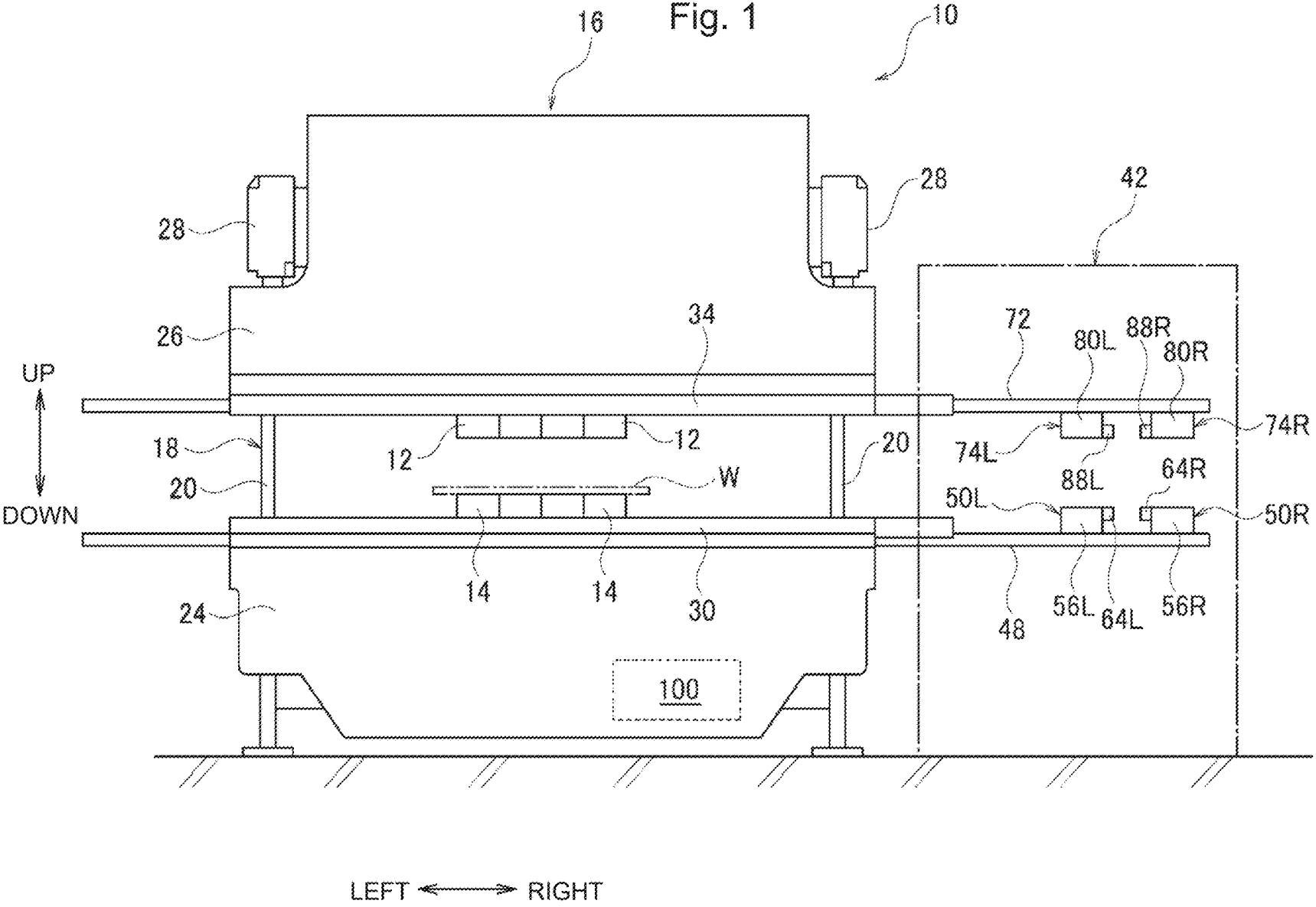
FIG. 1 is a front view schematically showing a configuration of a bending system according to a first embodiment.
Figure 2:
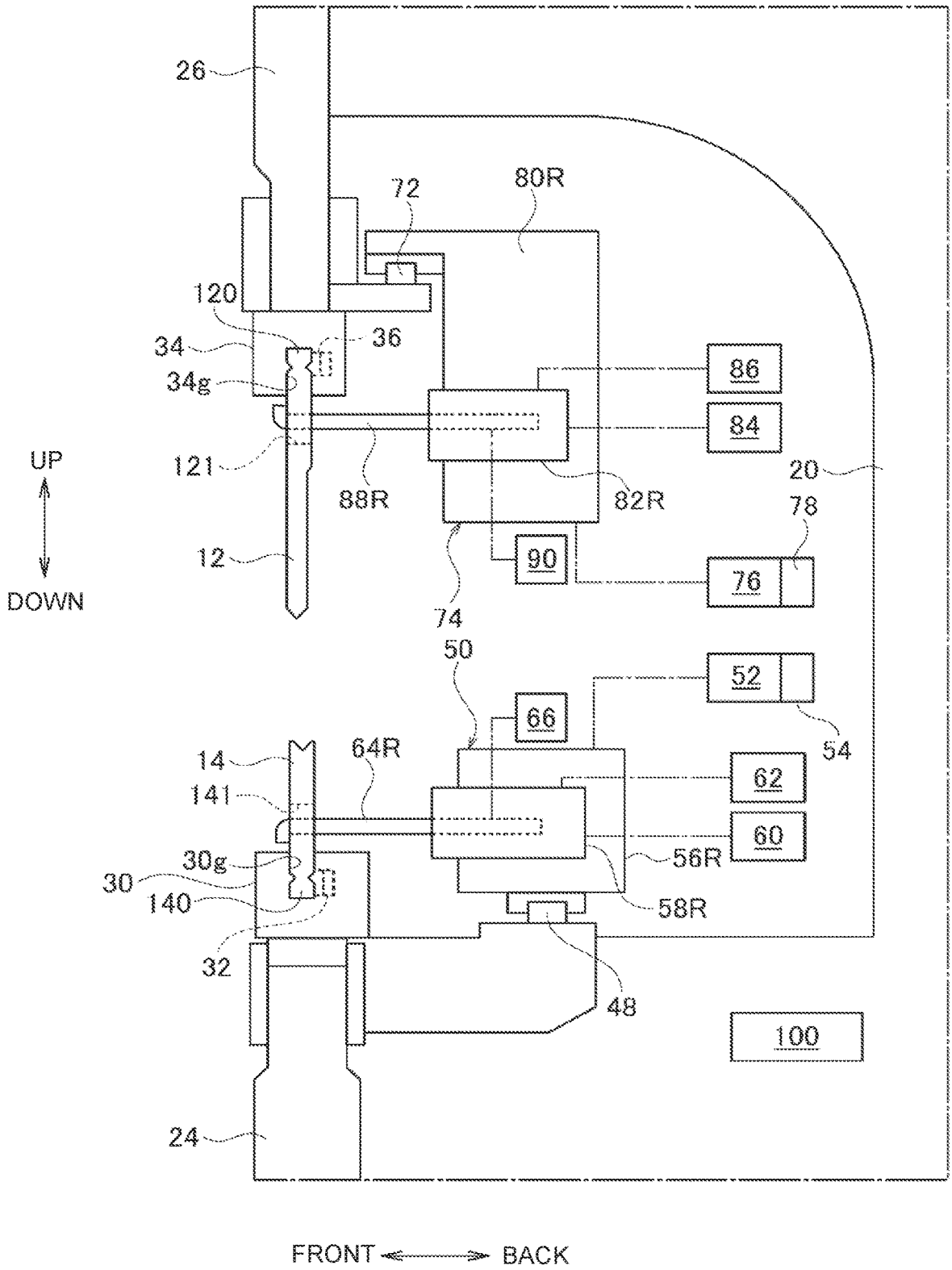
FIG. 2 is a side view schematically showing the configuration of the bending system shown in FIG. 1.

FIG. 1 is a front view schematically showing a configuration of a bending system according to a first embodiment. FIG. 2 is a side view schematically showing the configuration of the bending system shown in FIG. 1. A bending system 10 according to the first embodiment will be described with reference to FIGS. 1 and 2. In the following description, as definitions of directions, a left-right direction, a front-back direction, and an up-down direction are defined, but these directions are used only for convenience of description. Of the left-right direction, the front-back direction, and the up-down direction, the left-right direction and the front-back direction correspond to two directions that are orthogonal to each other in a horizontal direction, and the up-down direction corresponds to a vertical direction.

The bending system 10 includes a press brake 16 in which a plurality of lower tools 14 are arranged along the left-right direction in a lower tool holder 30 provided to a lower table 24, left and right lower tool change units 50L and 50R each including a lower tool retention member capable of being inserted into and removed from an insertion hole 141 provided to the lower tool 14 by moving forward and moving backward along the front-back direction, and provided on a rear surface side or a front surface side of the lower table 24 so as to be movable in the left-right direction, and a control device 100 configured to control each of the left and right lower tool change units 50L and 50R so as to perform a gathering operation of gathering the plurality of lower tools 14 so that there are no gaps between the lower tools 14. The gathering operation includes a restraint operation of moving forward a lower tool retention member 64L of the left lower tool change unit 50L so as to restrain a reference lower tool 14 positioned at one end of the plurality of lower tools 14 with the left lower tool retention member 64L, an inserting operation of moving forward a lower tool retention member 64R of the right lower tool change unit 50R so as to insert the lower tool retention member 64R into the insertion hole 141 of the target lower tool 14 selected from among remaining lower tools 14, which exclude a reference lower tool 14, of the plurality of lower tools 14, and an execution operation of moving the left and right lower tool change units 50L and 50R along the left-right direction so as to come close with each other so that the lower tools 14 from the reference lower tool 14 to the target lower tool 14 are gathered. When a failure of the inserting operation is determined, the control device 100 performs a retry operation of moving forward the right lower tool retention member 64R again to insert the right lower tool retention member 64R into the insertion hole 141 of the target lower tool 14 after moving backward the left lower tool retention member 64L to release the restraint operation of the reference lower tool 14. Needless to say, the above description relates to the gathering operation by way of the left and right lower tool change units 50L and 50R provided in correspondence with the lower tools 14, but the same applies to a gathering operation by way of left and right upper tool change units 74L and 74R provided in correspondence with upper tools 12.

The details of the bending system 10 will be described below. The bending system 10 is a system for bending a plate-shaped workpiece W such as a sheet metal, for example. The bending system 10 includes the press brake 16, the left and right lower tool change units 50L and 50R, the left and right upper tool change units 74L and 74R, and the control device 100.

The press brake 16 bends the workpiece W through a cooperation of the upper tool 12, which is an upper tool such as a punch, and the lower tool 14, which is a lower tool such as a die.

The press brake 16 includes a main frame 18. The main frame 18 includes left and right side plates 20 facing each other with a space therebetween in the left-right direction. The lower table 24 extending in the left-right direction is provided below the main frame 18, and an upper table 26 extending in the left-right direction is provided above the main frame 18. The upper table 26 is configured to be movable along the up-down direction. Above each of the side plates 20, a hydraulic cylinder 28 is provided as an actuator for an up-down movement that moves the upper table 26 in the up-down direction with respect to the main frame 18. It should be noted that instead of configuring the upper table 26 to be movable in the up-down direction, the lower table 24 may be configured to be movable in the up-down direction. Instead of the hydraulic cylinder 28, a servo motor may be used as the actuator for the up-down movement.

A lower tool holder 30 that holds the lower tool 14 in an installable and removable manner is provided on an upper side of the lower table 24. The lower tool holder 30 is configured, for example, to extend continuously along the left-right direction, but may be configured to be intermittently provided along the left-right direction at appropriate intervals. In the lower tool holder 30, a holder groove 30*g* for a shank portion (base portion) 140 of the lower tool 14 to be inserted is formed along the left-right direction. The lower tool holder 30 includes a hydraulic clamp 32 that secures the lower tool 14 to the lower table 24.

An upper tool holder 34 that holds the upper tool 12 in an installable and removable manner is provided on a lower side of the upper table 26. The upper tool holder 34 is configured, for example, to extend continuously along the left-right direction, but may be configured to be intermittently provided along the left-right direction at appropriate intervals. In the upper tool holder 34, a holder groove 34g for a shank portion (base portion) 120 of the upper tool 12 to be inserted is formed along the left-right direction. The upper tool holder 34 includes a hydraulic clamp 36 that secures the upper tool 12 to the upper table 26.

The insertion hole 141 that penetrates along the front-back direction is provided in a center portion of the lower tool 14 in the left-right direction (width direction). The position of the insertion hole 141 in the lower tool 14 attached to the lower tool holder 30 can be specified as a position corresponding to half the value of a tool width with reference to a position of one of left and right side surfaces of the lower tool 14. Further, in the same manner as the lower tool 14, an insertion hole 121 that penetrates along the front-back direction is provided to the upper tool 12.

The bending system 10 includes a tool rack 42 that stores a plurality of the lower tools 14 and a plurality of the upper tools 12 on a lateral side of the press brake in the left-right direction, in the present embodiment, on the right side.

The tool rack 42 includes a plurality of lower stockers each holding one or more lower tools 14, and the plurality of lower stockers are arranged side by side in the front-back direction. The plurality of lower stockers are configured to be movable in the up-down direction and the front-back direction by a stocker moving mechanism. The stocker moving mechanism can select an arbitrary lower stocker from among the plurality of lower stockers and move the selected lower stocker in the up-down direction and the front-back direction so as to position it at a change position for the lower tool. The change position for the lower tool is set at a position adjacent to the lower tool holder 30 in the left-right direction.

Further, the tool rack 42 includes a plurality of upper stockers each holding one or more upper tools 12. The configuration of each of the upper stocker is similar to that of the lower stocker.

The left and right lower tool change units 50L and 50R perform transport of the lower tool 14 between the lower tool holder 30 and the lower stocker positioned at the change position for the lower tool, arrangement of the lower tool 14 in the lower tool holder 30, and the like. The left and right lower tool change units 50L and 50R correspond to first and second moving bodies provided in correspondence with the lower tool 14.

The left and right lower tool change units 50L and 50R are provided on a rear surface side of the lower table 24. A lower guide 48 extending in the left-right direction is provided on a rear surface side of the lower tool holder 30. Each of the lower tool change units 50L and 50R is configured to be movable in the left-right direction via the lower guide 48.

The left and right lower tool change units 50L and 50R are configured independently of each other and can operate independently of each other. Since the configurations of the left and right lower tool change units 50L and 50R correspond to each other, the right lower tool change unit 50R will be taken as an example below to describe the configuration thereof.

The right lower tool change unit 50R is moved in the left-right direction by a driving of a servo motor 52 as an actuator for a lateral movement. The servo motor 52 includes an encoder 54 as a position detector that detects a position in the left-right direction of the lower tool change unit 50R.

The right lower tool change unit 50R includes a lower unit main body 56R provided to the lower guide 48 so as to be movable in the left-right direction, and a lower support member 58R provided to the lower unit main body 56R so as to be movable in the front-back direction and the up-down direction. The lower support member 58R is moved in the front-back direction with respect to the lower unit main body 56R by a driving of a first air cylinder 60 as an actuator for a front-back movement. The lower support member 58R is moved in the up-down direction with respect to the lower unit main body 56R by a driving of a second air cylinder 62 that is an actuator for an up-down movement.

The right lower tool change unit 50R includes the lower tool retention member 64R provided to the lower support member 58R so as to be movable in the front-back direction. The lower tool retention member 64R is moved in the front-back direction with respect to the lower support member 58R by a driving of a third air cylinder 66 as an actuator for the front-back movement. The lower tool retention member 64R is configured to be insertable into the insertion hole 141 of the lower tool 14.

As described above, the left and right lower tool change units 50L and 50R transport and arrange the lower tool 14 in the lower tool holder 30. The lower tool change units 50L and 50R respectively move forward the lower tool retention members 64R and 64L to insert the lower tool retention members 64R and 64L into the insertion holes 141 of the lower tools 14, which makes it possible to hold the lower tools 14.

In a state in which the respective lower tool retention members 64R and 64L hold the lower tools 14, the lower tool change units 50L and 50R move in the left-right direction, which makes it possible to transport the lower tools 14 in the left-right direction. Then, by positioning the lower tool change units 50L and 50R at predetermined positions, the lower tools 14 can be arranged at desired positions of the lower tool holder 30.

The left and right lower tool change units 50L and 50R can transport and arrange the lower tools 14 independently from each other. Further, the left and right lower tool change units 50L and 50R respectively hold the lower tools 14 positioned at both of the left and right ends of the plurality of lower tools 14, which makes it possible to collectively transport and arrange the plurality of lower tools 14.

When the lower tool 14 is transported and arranged, there may be a sufficient gap on the left side or the right side of the target lower tool 14. In this case, the lower tool 14 may be transported by bringing the lower tool retention members 64R and/or 64L into contact with one of the left and right side surfaces of the lower tool 14 without inserting the lower tool retention members 64R and 64L into the insertion holes 141, and then pushing a side surface thereof in the left-right direction.

The left and right upper tool change units 74L and 74R perform transport of the upper tool 12 between the upper tool holder 34 and the upper stocker positioned at a change position for the upper tool, arrangement of the upper tool 12 in the upper tool holder 34, and the like. The left and right upper tool change units 74L and 74R correspond to the first and second moving bodies provided in correspondence with the upper tool 12.

The configurations of the left and right upper tool change units 74L and 74R correspond to the configurations of the left and right lower tool change units 50L and 50R described above. In other words, an upper guide 72, a servo motor 76, an encoder 78, an upper unit main body 80R (80L), an upper support member 82R (82L), a first air cylinder 84, a second air cylinder 86, an upper tool retention member 88R (88L), and a third air cylinder 90 in the upper tool change unit 74R (74L) correspond to the lower guide 48, the servo motor 52, the encoder 54, the lower unit main body 56R (56L), the lower support member 58R (58L), the first air cylinder 60, the second air cylinder 62, the lower tool retention member 64R (64L), and the third air cylinder 66 in the lower tool change unit 50R (50L), respectively.

The control device 100 is a device that controls an operation of the bending system 10. The control device 100 is, for example, a computer such as an NC device. The computer is mainly composed of a hardware processor such as a CPU (central processing unit), a memory, and various types of interfaces. The memory and the various types of interfaces are connected to the hardware processor via buses.

Predetermined computer programs are installed on the computer. The hardware processor executes the computer programs so that the computer executes a plurality of functions provided to the control device 100.

The control device 100 controls an operation of the press brake 16 based on a processing program. Further, the control device 100 controls operations of the left and right lower tool change units 50L and 50R and the left and right upper tool change units 74L and 74R, respectively, based on a tool change program and setup data. Under this control, the transport of the upper tool 12 and the lower tool 14, the respective arrangement of the upper tool 12 and the lower tool 14 in the upper tool holder 34 and the lower tool holder 30, and the like are performed. The memory of the control device 100 stores the processing program, the tool change program, and the setup data.

The setup data is a data representing one or more tool stages simultaneously arranged in the tool holders (the upper tool holder 34 and the lower tool holder 30) of the press brake 16 among the plurality of tools (the upper tool 12 and the lower tool 14) of the bending system 10. Specifically, the setup data includes information such as a setup number, a tool layout, and a component to be processed. The tool layout includes a tool number of the tool that makes up each stage, a length of the tool in a width direction, a mounting position of the tool in the tool holder, and the like.

The tool stage arranged in the tool holder is composed of one tool or a group of tools in which the plurality of tools are combined in the left-right direction. When one tool stage is composed of the tool group in which the plurality of tools are combined, these tools are continuously arranged in the left-right direction so that there are no gaps between the tools.

Hereinafter, a description will be given of an operation, in the bending system 10 according to the present embodiment, of arranging the lower tool 14 and the upper tool 12 at the desired positions of the lower tool holder 30 and the upper tool holder 34, respectively, by using the left and right lower tool change units 50L and 50R and the left and right upper tool change units 74L and 74R. In the following description, an operation of the left and right lower tool change units 50L and 50R will be taken as an example to describe an operation of arranging a tool stage made up of a plurality of lower tools 14 at a desired position of the lower tool holder 30. Needless to say, the same applies to an operation of arranging a plurality of upper tools 12 in the upper tool holder 34 by using the left and right upper tool change units 74L and 74R.

The control device 100 arranges the plurality of lower tools 14 at predetermined positions of the lower tool holder 30 by position control of the left and right lower tool change units 50L and 50R. Specifically, the control device 100 controls the servo motors 52 that drive the left and right lower tool change units 50L and 50R, respectively, so as to perform the position controls of the left and right lower tool change units 50L and 50R in the left-right direction. In the position controls, the control device 100 can recognize the position of each of the left and right lower tool change units 50L and 50R in the left-right direction based on a detection signal supplied from the encoder 54 that detects the number of rotations of the servo motor 52. By performing the position controls, the control device 100 can move the left and right lower tool change units 50L and 50R in the left-right direction and position them at the predetermined positions in the left-right direction. The plurality of lower tools 14 can be arranged at the desired positions of the lower tool holder 30 by the movements in the left-right direction of the left and right lower tool change units 50L and 50R and the positioning operation thereof.

On the other hand, even when the plurality of lower tools 14 are arranged at the desired positions of the lower tool holder 30 by the position controls, a slight gap may be generated between the adjacent lower tools 14 due to various circumstances such as a backlash of the driving mechanism, a deflection of the lower tool retention members 64L or 64R, and a negative drawing tolerance of the lower tool 14. Therefore, the control device 100 controls the left and right lower tool change units 50L and 50R to perform the gathering operation of gathering the plurality of lower tools 14 so as to eliminate the gap generated between the lower tools. This gathering operation is performed by operating the left and right lower tool change units 50L and 50R under the position controls by the control device 100.

FIGS. 3A to 3D and FIGS. 4A to 4D are diagrams showing a procedure of the gathering operation according to the first embodiment. The gathering operation according to the first embodiment will be described below with reference to FIGS. 3A to 3D and FIGS. 4A to 4D. In these figures, seven lower tools 14*a* to 14*h* are shown as examples of the plurality of lower tools 14. The seven lower tools 14*a* to 14*h* are arranged from left to right in the order of the lower tool 14*a*, the lower tool 14*b*, the lower tool 14*c*, the lower tool 14*d*, the lower tool 14*e*, the lower tool 14*f*, the lower tool 14*g*, and the lower tool 14*h*.

In the bending system 10 according to the present embodiment, the tool rack 42 is arranged on the right side of the press brake 16. As a result, the lower tool 14 transported from the tool rack 42 to the lower tool holder 30 mainly moves from the right side to the left side. Therefore, among the seven lower tools 14*a* to 14*h*, the lower tool 14*a* positioned at the leftmost end is used as a reference lower tool 14*a* that serves as a reference for the gathering operation. However, the reference lower tool is not limited to the lower tool 14*a*.

Figure 3A:
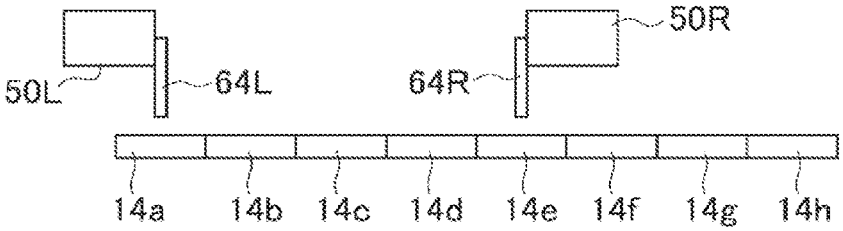
FIG. 3A is a diagram showing a part of a procedure of a gathering operation according to the first embodiment.

As shown in FIG. 3A, the control device 100 moves the left lower tool change unit 50L in the left-right direction to align the left lower tool change unit 50L with the reference lower tool 14*a* (an alignment operation). The alignment operation is performed so that the position of the left lower tool retention member 64L and the position of the insertion hole 141 of the reference lower tool 14*a* are matched (the same applies to the following alignment operation).

The control device 100 selects, as a first target lower tool, an arbitrary lower tool from among the remaining lower tools 14*b* to 14*h* that exclude the reference lower tool 14*a*.

In the present embodiment, the lower tool 14*e* positioned in the middle of the remaining lower tools 14*b* to 14*h* is used as the first target lower tool 14*e*. The control device 100 moves the right lower tool change unit 50R in the left-right direction to align the right lower tool change unit 50R with the target lower tool 14*e* (the alignment operation).

Figure 3B:
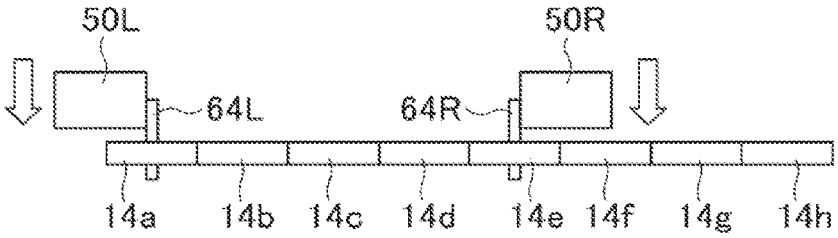
FIG. 3B is a diagram showing a part of the procedure of the gathering operation according to the first embodiment.

As shown in FIG. 3B, the control device 100 moves forward the left lower tool retention member 64L to insert the left lower tool retention member 64L into the insertion hole 141 of the reference lower tool 14*a*. By inserting the left lower tool retention member 64L into the insertion hole 141 of the reference lower tool 14*a*, the reference lower tool 14*a* is restricted by the left lower tool retention member 64L (restraint operation). In the same manner, the control device 100 moves forward the right lower tool retention member 64R to insert the lower tool retention member 64R into the insertion hole 141 of the target lower tool 14*e* (inserting operation). The timing of moving forward the right lower tool retention member 64R may be simultaneous with the timing of moving forward the left lower tool retention member 64L, or may be after moving forward the left lower tool retention member 64L.

Figure 3C:
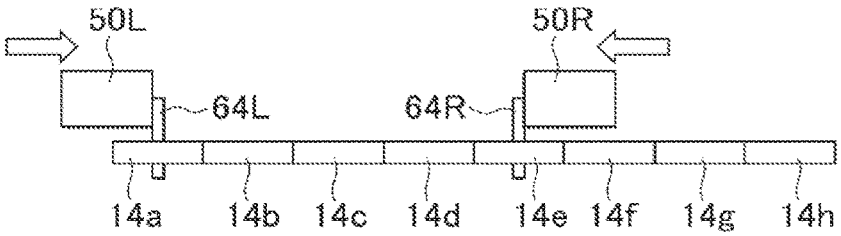
FIG. 3C is a diagram showing a part of the procedure of the gathering operation according to the first embodiment.

As shown in FIG. 3C, the control device 100 moves the left lower tool change unit 50L and the right lower tool change unit 50R along the left-right direction so as to come close with each other so that the five lower tools 14*a* to 14*e* from the reference lower tool 14*a* to the target lower tool 14*e* are gathered in the center (execution operation).

When the execution operation is completed, the control device 100 selects, as a second target lower tool (a new target lower tool) 14*h*, the lower tool 14*h* positioned at the rightmost end from among the seven lower tools 14*a* to 14*h*. Then, the control device 100 uses the right lower tool retention member 64R to perform the inserting operation and the execution operation to the new target lower tool 14*h* while the restraint operation of the reference lower tool 14*a* with the left lower tool retention member 64L is being continued.

Figure 3D:
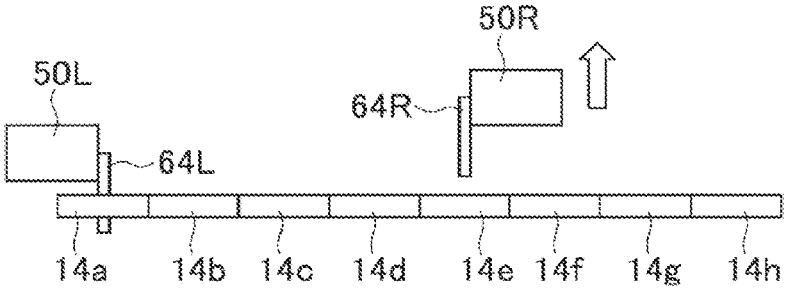
FIG. 3D is a diagram showing a part of the procedure of the gathering operation according to the first embodiment.
Figure 4A:
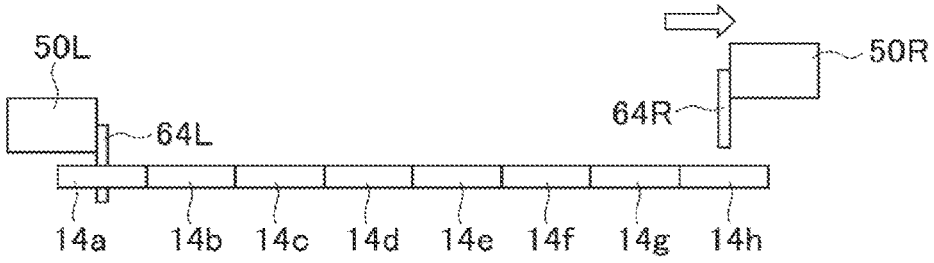
FIG. 4A is a diagram showing a part of the procedure of the gathering operation according to the first embodiment.
Figure 4B:
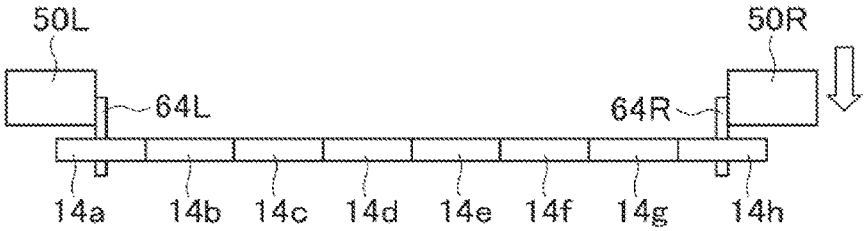
FIG. 4B is a diagram showing a part of the procedure of the gathering operation according to the first embodiment.
Figure 4C:
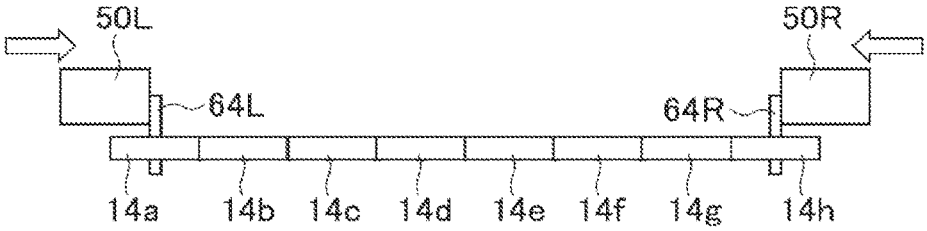
FIG. 4C is a diagram showing a part of the procedure of the gathering operation according to the first embodiment.

Specifically, as shown in FIG. 3D, the control device 100 moves backward the right lower tool retention member 64R to pull out the right lower tool retention member 64R from the insertion hole 141 of the target lower tool 14*e*. As shown in FIG. 4A, the control device 100 moves the right lower tool change unit 50R in the left-right direction to align the right lower tool change unit 50R with the target lower tool 14*h* (alignment operation). Then, as shown in FIG. 4B, the control device 100 moves forward the right lower tool retention member 64R to insert the right lower tool retention member 64R into the insertion hole 141 of the target lower tool 14*h* (inserting operation). As shown in FIG. 4C, the control device 100 moves the left lower tool change unit 50L and the right lower tool change unit 50R along the left-right direction so as to come close with each other so that the seven lower tools 14*a* to 14*h* from the reference lower tool 14*a* to the target lower tool 14*h* are gathered in the center (execution operation).

Figure 4D:
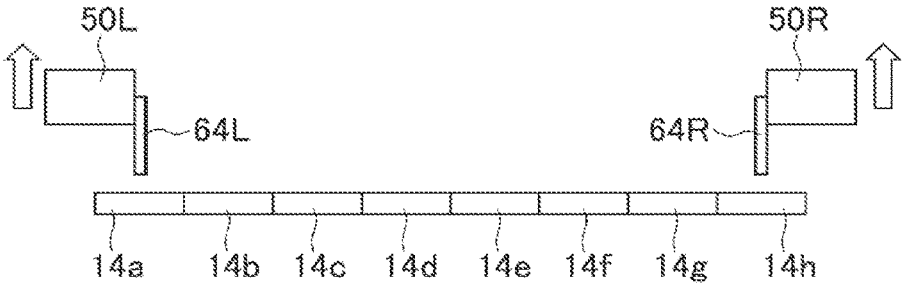
FIG. 4D is a diagram showing a part of the procedure of the gathering operation according to the first embodiment.

Finally, as shown in FIG. 4D, the control device 100 moves backward the left lower tool retention member 64L and the right lower tool retention member 64R so that the left and right lower tool retention members 64L and 64R are pulled out from the insertion holes 141 of the reference lower tool 14*a* and the target lower tool 14*h*, respectively.

As described above, by performing the gathering operation, the seven lower tools 14*a* to 14*h* can be arranged at the desired positions of the lower tool holder 30 in a state in which there are no gaps between the lower tools.

It should be noted that in the explanation of the gathering operation described above, a method of switching the target lower tool twice is explained, such as the lower tool 14*e* positioned in the middle and the lower tool 14*h* positioned at the right end among the seven lower tools 14*a* to 14*h*. However, the number of times the target lower tool is switched can be set to a required number of times according to the number and the overall length of the lower tools 14 constituting the tool stage. Further, in the switching of the target lower tools, an arbitrary number of lower tools 14 according to the number of times of the switching may be selected in order from the left side to the right side from among the remaining tools that exclude the reference lower tool 14*a*.

Further, in the gathering operation described above, if the left lower tool retention member 64L has already been inserted into the insertion hole 141 of the reference lower tool 14*a*, the operation of aligning the left lower tool change unit 50L with the reference lower tool 14*a* and the operation of inserting the left lower tool retention member 64L into the insertion hole 141 of the reference lower tool 14*a* are omitted in the explanation described above.

Now, in such a gathering operation, the inserting operation may fail, such as being unable to insert the right lower tool retention member 64R into the insertion hole 141 of the target lower tool 14*e* or 14*h*. The control device 100 monitors a stroke operation of each of the first air cylinder 60 and the third air cylinder 66, and determines a failure of the inserting operation on the condition that the cylinder 60 or 66 has not reached a predetermined stroke end.

Causes of the failure of the inserting operation include (1) a mechanical inclination of the lower tool retention member 64L or 64R, (2) a misalignment of a reference position of the lower tool change unit 50L or 50R defined with a predetermined position (for example, the center) of the lower table 24 as a reference, (3) a difference between a nominal size and an actual size of the lower tool 14 in terms of length, and a difference between an actual position and a theoretical position of the insertion hole 141 resulting from this, (4) a difference between an actual position and a theoretical position of the lower tool retention member 64L or 64R due to a deflection, and the like. Further, in the gathering operation, the inserting operation and the execution operation are repeated for a plurality of target tools while the reference lower tool 14*a* is restrained by the left lower tool retention member 64L. Since a press force from the lower tool retention member 64L acts on the reference lower tool 14*a* each time the execution operation is performed, the gathered lower tools 14 tend to be pushed out to the right as a whole. Therefore, such pushing is repeated each time the execution operation is repeated, and slight misalignments are accumulated, which is likely to generate a position misalignment in the lower tool 14 positioned on the right side.

When the failure of the inserting operation is determined, the control device 100 performs the retry operation. The retry operation will be described in detail below. The retry operation is an operation of moving forward the right lower tool retention member 64R again so as to insert the right lower tool retention member 64R again into the insertion holes 141 of the target lower tools 14*e* and 14*h*. The retry operation will be described below by taking the inserting operation into the target lower tool 14*h* as an example. The retry operation includes an initial operation, a first retry operation, and a second retry operation.

Figure 5A:
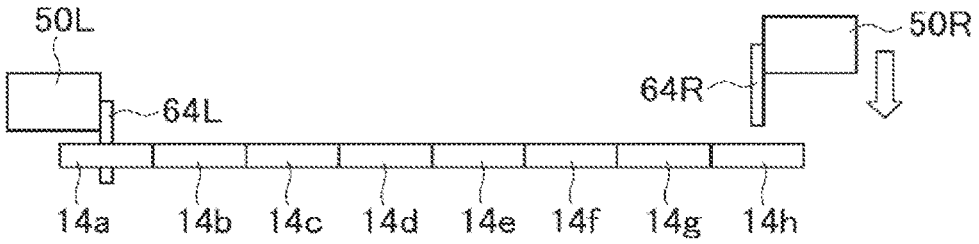
FIG. 5A is a diagram showing a procedure of an initial operation.
Figure 5B:
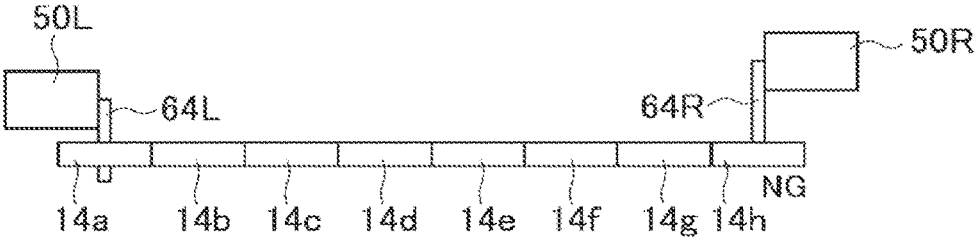
FIG. 5B is a diagram showing the procedure of the initial operation.

The initial operation will be described with reference to FIGS. 5A to 5D. FIGS. 5A to 5D are diagrams showing a procedure of the initial operation. In the following description of the retry operation, it is assumed that a failure occurs in the inserting operation of inserting the right lower tool retention member 64R into the insertion hole 141 of the target lower tool 14*h* (FIGS. 5A and 5B).

Figure 5C:
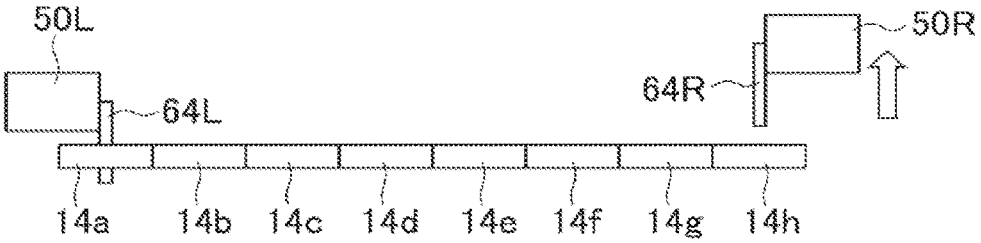
FIG. 5C is a diagram showing the procedure of the initial operation.

First, as shown in FIG. 5C, the control device 100 moves backward the right lower tool retention member 64R to separate the right lower tool retention member 64R from the target lower tool 14*h*.

Figure 5D:
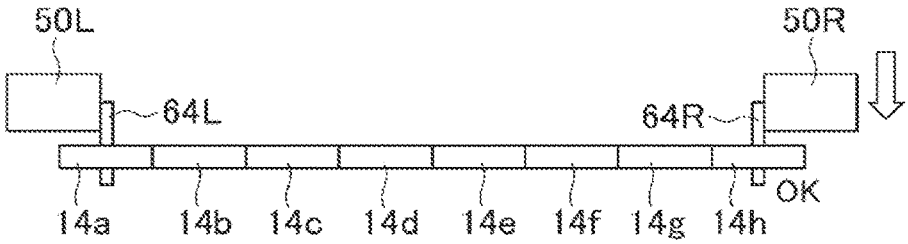
FIG. 5D is a diagram showing the procedure of the initial operation.

Then, as shown in FIG. 5D, the control device 100 moves forward the right lower tool retention member 64R to insert the right lower tool retention member 64R into the insertion hole 141 of the target lower tool 14*h*.

In this manner, the initial operation is an operation of moving forward the right lower tool retention member 64R again while the restraint operation of the reference lower tool 14*a* with the left lower tool retention member 64L is being continued so as to try to insert the right lower tool retention member 64R into the insertion hole 141 of the target lower tool 14*h*.

The first retry operation will be described with reference to FIGS. 6A to 6D. FIGS. 6A to 6D are diagrams showing a procedure of the first retry operation. If the inserting operation into the target lower tool 14*h* fails even after the initial operation is executed as described above (FIGS. 6A and 6B), the control device 100 performs the first retry operation.

Figure 6A:
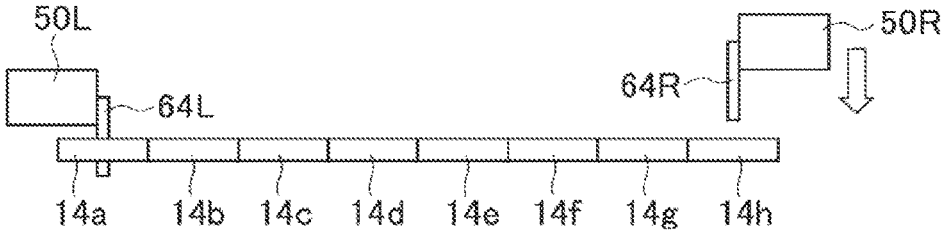
FIG. 6A is a diagram showing a procedure of a first retry operation.
Figure 6B:
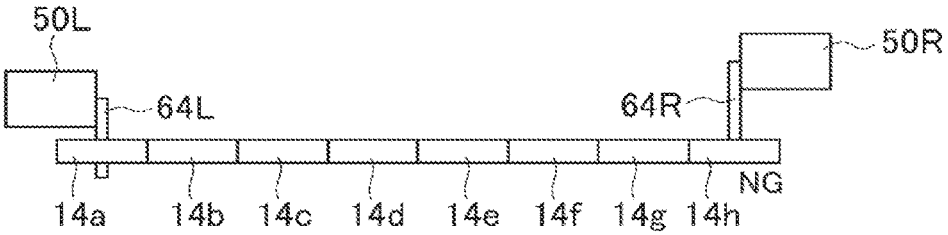
FIG. 6B is a diagram showing the procedure of the first retry operation.
Figure 6C:
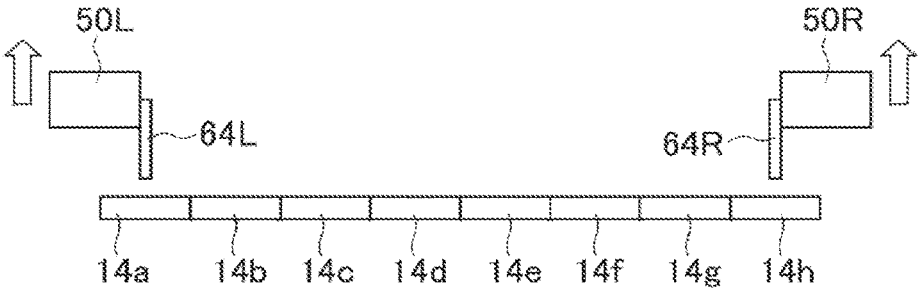
FIG. 6C is a diagram showing the procedure of the first retry operation.

First, as shown in FIG. 6C, the control device 100 moves backward the left lower tool retention member 64L to pull out the lower tool retention member 64L from the insertion hole 141 of the reference lower tool 14*a*. As a result, the reference lower tool 14*a* is released from the restraint operation with the left lower tool retention member 64L. At the same time, the control device 100 moves backward the right lower tool retention member 64R to separate the lower tool retention member 64R from the target lower tool 14*h*.

Figure 6D:
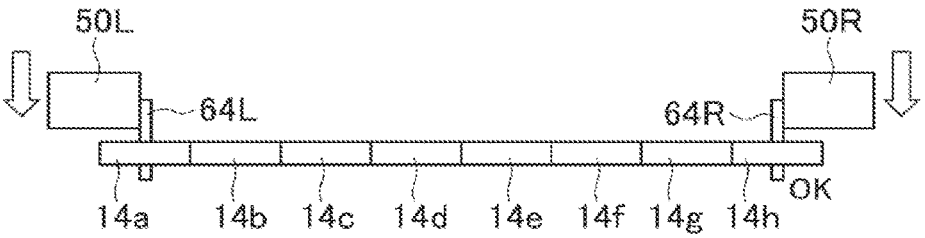
FIG. 6D is a diagram showing the procedure of the first retry operation.

Next, as shown in FIG. 6D, the control device 100 respectively moves forward the left and right lower tool retention members 64L and 64R so as to insert the left and right lower tool retention members 64L and 64R into the insertion holes 141 of the reference lower tool 14*a* and the target lower tool 14*h*, respectively.

In this manner, the first retry operation is an operation of respectively moving forward the left and right lower tool retention members 64L and 64R so as to try to insert the right lower tool retention member 64R into the insertion hole 141 of the target lower tool 14*h* after the left lower tool retention member 64L is moved backward to release the restraint operation of the reference lower tool 14*a*.

The second retry operation will be described below with reference to FIGS. 7A to 7D. FIGS. 7A to 7D are diagrams showing a procedure of the second retry operation. If the inserting operation into the target lower tool 14*h* fails even after the first retry operation is executed (FIG. 7A), the control device 100 executes the second retry operation.

Figure 7A:
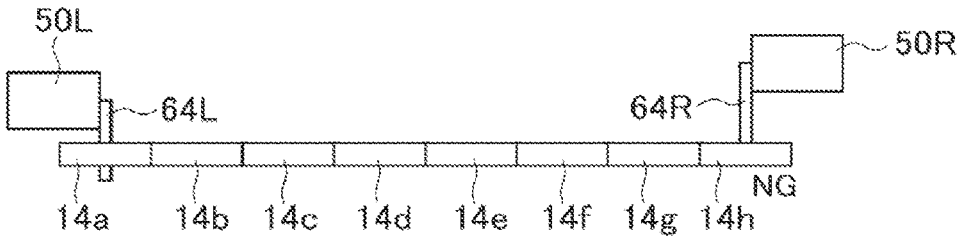
FIG. 7A is a diagram showing a procedure of a second retry operation.
Figure 7B:
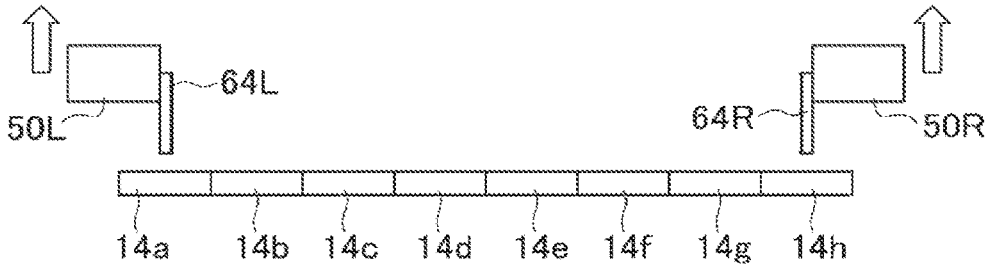
FIG. 7B is a diagram showing the procedure of the second retry operation.

As shown in FIG. 7B, the control device 100 moves backward the left lower tool retention member 64L to pull out the lower tool retention member 64L from the insertion hole 141 of the reference lower tool 14*a*. As a result, the reference lower tool 14*a* is released from the restraint operation with the left lower tool retention member 64L. At the same time, the control device 100 moves backward the right lower tool retention member 64R to separate the lower tool retention member 64R from the target lower tool 14*h*.

Figure 7C:
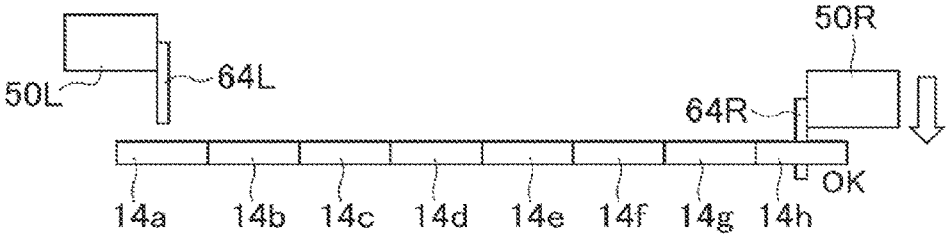
FIG. 7C is a diagram showing the procedure of the second retry operation.

As shown in FIG. 7C, the control device 100 moves forward the right lower tool retention member 64R to insert the right lower tool retention member 64R into the insertion hole 141 of the target lower tool 14*h*.

Figure 7D:
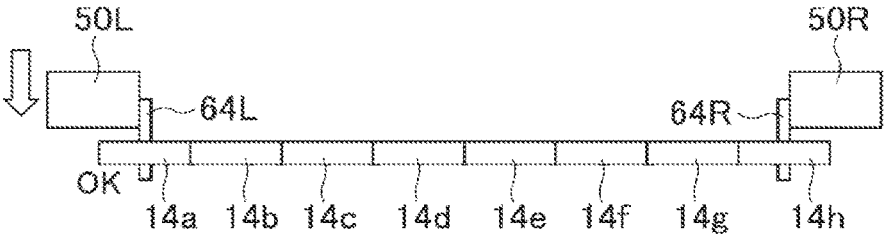
FIG. 7D is a diagram showing the procedure of the second retry operation.

When the right lower tool retention member 64R is successfully inserted into the target lower tool 14*h*, as shown in FIG. 7D, the control device 100 moves forward the left lower tool retention member 64L to insert the left lower tool retention member 64L into the insertion hole 141 of the reference lower tool 14*a*.

In this manner, in the second retry operation, the right lower tool retention member 64R is moved forward again and then the left lower tool retention member 64L is moved forward again after the left lower tool retention member 64L is moved backward to release the restraint operation of the reference lower tool 14*a*. As a result, the second retry operation is an operation of trying to insert the right lower tool retention member 64R into the insertion hole 141 of the target lower tool 14*h*.

In this manner, according to the present embodiment, when the failure of the inserting operation is determined, the retry operation is performed. This retry operation is performed in a state in which the left lower tool retention member 64L is moved backward and the reference lower tool 14*a* is released from the restraint. By releasing the reference lower tool 14*a* from the restraint, a margin is generated for the reference lower tool 14*a* to slightly move toward the left. As a result, the lower tools 14*a* to 14*h* from the reference lower tool 14*a* to the target lower tool 14*h* can be slightly moved to the left as a whole, and the position of the target lower tool 14*h* is moved. In the retry operation, the right lower tool retention member 64R can be easily inserted into the target lower tool 14*h*. As a result, even if the inserting operation fails once, if the right lower tool retention member 64R can be inserted into the target lower tool 14*h* by the retry operation, the gathering operation can be continued without generating an alarm due to the failure. As a result, tool arrangement with high positional accuracy can be completed.

Further, although the left and right lower tool retention members 64L and 64R are moved forward simultaneously in the first retry operation, only the right lower tool retention member 64R can be moved forward in advance in the second retry operation. In the second retry operation, even when the right lower tool retention member 64R is moved forward, the restraint operation to the reference lower tool 14*a* remains released. Therefore, the margin is generated for the reference lower tool 14*a* to slightly move to the left. As a result, the lower tools 14*a* to 14*h* from the reference lower tool 14*a* to the target lower tool 14*h* can be slightly moved to the left as a whole, and the right lower tool retention member 64R can be inserted into the target lower tool 14*h*.

It should be noted that in the embodiment described above, the first retry operation is executed in advance, and the second retry operation is additionally executed when the insertion failure occurs there. However, if the insertion failure occurs, only the second retry operation may be executed without executing the first retry operation.

According to the present embodiment, the target lower tool is newly selected from among the remaining lower tools 14*b* to 14*h*, while the restraint operation is being continued, so as to repeatedly perform the inserting operation and the execution operation. Since the press force from the lower tool retention member 64L acts on the reference lower tool 14*a* each time the execution operation is performed, the gathered lower tools 14 tend to be pushed out to the right as a whole. Therefore, such pushing is repeated each time the execution operation is repeated, and the slight misalignments are accumulated, which is likely to generate the positional misalignment in the lower tool 14 positioned on the right side. In this manner, when the target lower tool is switched, an environment is created in which the failure of the inserting operation is likely to occur. However, by performing the retry operation after releasing the restraint operation of the reference lower tool 14*a*, the right lower tool retention member 64R can be inserted into the target lower tool 14*h*. As a result, the gathering operation can be continued without generating the alarm due to the insertion failure.

According to the present embodiment, the restraint operation of the reference lower tool 14*a* is released by moving backward the left lower tool retention member 64L. According to the present configuration, the left lower tool retention member 64L can be pulled out from the insertion hole 141 of the reference lower tool 14*a* by moving backward the left lower tool retention member 64L. As a result, the restraint operation of the reference lower tool 14*a* can be appropriately released.

Further, according to the present embodiment, the initial operation is executed before the first retry operation and the second retry operation are executed. The initial operation is the operation to move forward the right lower tool retention member 64R again while the restraint operation with the left lower tool retention member 64L is being continued. Therefore, if the initial operation can lead to a successful insertion, it is possible to shift to the execution operation in a short period of time. As a result, the lower tool arrangement with high positional accuracy can be realized in a short period of time.

It should be noted that in the present embodiment, the first retry operation and the second retry operation are executed after the initial operation is executed. However, if the insertion failure is determined, the retry operation may be executed without executing the initial operation.

It should be noted that in the embodiment described above, when the restraint operation of restraining the reference lower tool 14*a* with the left lower tool retention member 64L is performed, the left lower tool retention member 64L is inserted into the insertion hole 141 of the reference lower tool 14*a*. However, the reference lower tool 14*a* may be restrained by bringing the left lower tool retention member 64L into contact with a side surface on the left side of the reference lower tool 14*a*.

Further, in the present embodiment, when the gathering operation (the execution operation) for the target lower tool 14*h* positioned at the right end is performed, the right lower tool retention member 64R is inserted into the insertion hole 141 of the target lower tool 14*h*. However, if there is a sufficient space on the right side of the target lower tool 14*h*, the gathering operation may be performed by bringing the right lower tool retention member 64R into contact with a side surface on the right side of the target lower tool 14*h*. Since it is possible to reduce the number of times the right lower tool retention member 64R is inserted into the insertion hole 141 of the lower tool 14 in the gathering operation, the possibility of the insertion failure can be reduced.

In the present embodiment, when the left and right lower tool retention members 64L and 64R are moved forward in the retry operation, the left and right lower tool change units 50L and 50R are kept in a stationary state in the left-right direction. The left and right lower tool change units 50L and 50R may be moved in the left-right direction by a predetermined amount.

First, a first method will be described. In this first method, the control device 100 controls the servo motor 52 of the right lower tool change unit 50R and the servo motor 52 of the left lower tool change unit 50L as follows.

For example, during the first retry operation shown in FIGS. 6A to 6D, the control device 100 moves backward the left and right lower tool retention members 64L and 64R (FIG. 6C) so as to move the left and right lower tool change units 50L and 50R by a slight amount by driving the respective servo motors 52 of the left and right lower tool change units 50L and 50R. Then, the control device 100 moves forward the left and right lower tool retention members 64L and 64R to insert the left and right lower tool retention members 64L and 64R into the insertion holes 141 of the lower tools 14*a* and 14*h*, respectively (FIG. 6D).

In the same manner, during the second retry operation shown in FIGS. 7A to 7D, the control device 100 moves backward the left and right lower tool retention members 64L and 64R (FIG. 7B) so as to move the left and right lower tool change units 50L and 50R by a slight amount by driving the respective servo motors 52 of the left and right lower tool change units 50L and 50R. Then, the control device 100 moves forward the right lower tool retention member 64R to insert the right lower tool retention member 64R into the insertion hole 141 of the target lower tool 14*h* (FIG. 7C). Further, the control device 100 moves forward the left lower tool retention member 64L to insert the left lower tool retention member 64L into the insertion hole 141 of the reference lower tool 14*a* (FIG. 7D).

According to this first method, the control device 100 controls the servo motor 52 (the driving mechanism) that drives the right lower tool change unit 50R in the left-right direction and the servo motor 52 (the driving mechanism) that drives the left lower tool change unit 50L in the left-right direction so as to move the left and right lower tool change units 50L and 50R by the predetermined amount by a driving force of the driving mechanism. According to the present configuration, even when there are the misalignments between the insertion holes 141 of the lower tools 14*a* and 14*h* and the left and right lower tool retention members 64L and 64R, respectively, the misalignments between the insertion holes 141 of the lower tools 14*a* and 14*h* and the left and right lower tool retention members 64L and 64R, respectively, can be reduced by moving the left and right lower tool change units 50L and 50R by the predetermined amount. As a result, the failure of the inserting operation in the retry operation can be suppressed.

It should be noted that in the above description, the left and right lower tool change units 50L and 50R are respectively moved. However, only the right lower tool change unit 50R, which corresponds to the target lower tool 14*h*, may be moved in the left-right direction by the predetermined amount. Further, a direction in which the left and right lower tool change units 50L and 50R are moved is a direction in which the misalignments between the insertion holes 141 and the left lower tool retention member 64L and the right lower tool retention member 64R are reduced, and the direction is determined in advance to be either one of the left and right in consideration of mechanical characteristics of the system.

Next, a second method will be described. In this second method, the control device 100 controls the servo motor 52 of the right lower tool change unit 50R and the servo motor 52 of the left lower tool change unit 50L as follows.

For example, in the first retry operation shown in FIGS. 6A to 6D, when the left and right lower tool retention members 64L and 64R are moved backward (FIG. 6C), the control device 100 stops power supply to the respective servo motors 52 of the left and right lower tool change units 50L and 50R so as to be in a servo-off state. As a result, a braking force that restricts the movements in the left-right direction of the left and right lower tool change units 50L and 50R is released, which makes it possible for the left and right lower tool change units 50L and 50R to move freely in the left-right direction. Then, the control device 100 moves forward the left and right lower tool retention members 64L and 64R, which are still in the servo-off state, so as to insert the right lower tool retention member 64R into the insertion hole 141 of the target lower tool 14*h* (FIG. 6D).

In the same manner, in the second retry operation shown in FIGS. 7A to 7D, when the left and right lower tool retention members 64L and 64R are moved backward (FIG. 7B), the control device 100 stops power supply to the respective servo motors 52 of the left and right lower tool change units 50L and 50R so as to be in the servo-off state. As a result, the braking force that restricts the movements in the left-right direction of the left and right lower tool change units 50L and 50R is released, which makes it possible for the left and right lower tool change units 50L and 50R to move freely in the left-right direction. Then, the control device 100 moves forward the right lower tool retention member 64R, which is still in the servo-off state, so as to insert the right lower tool retention member 64R into the insertion hole 141 of the target lower tool 14*h* (FIG. 7C). Further, the control device 100 moves forward the left lower tool retention member 64L, which is still in the servo-off state, so as to insert the left lower tool retention member 64L into the insertion hole 141 of the reference lower tool 14*a* (FIG. 7D).

According to the second method, the control device 100 controls the servo motor 52 (the driving mechanism) that drives the right lower tool change unit 50R in the left-right direction and the servo motor 52 (the driving mechanism) that drives the left lower tool change unit 50L in the left-right direction so as to release the braking force that restricts the movements in the left-right direction of the left and right lower tool change units 50L and 50R. Thereby, the left and right lower tool change units 50L and 50R are moved by the predetermined amount due to external forces that the left and right lower tool retention members 64L and 64R receive from the insertion holes 141. According to the present configuration, even when there are the misalignments between the insertion holes 141 of the lower tools 14*a* and 14*h* and the left and right lower tool retention members 64L and 64R, respectively, the left and right lower tool retention members 64L and 64R receive the external forces from the insertion holes 141 when the left and right lower tool retention members 64L and 64R are moved forward. Therefore, the left and right lower tool change units 50L and 50R are moved so that the left and right lower tool retention members 64L and 64R are guided to the positions of the insertion holes 141. As a result, it is possible to suppress the failure of the inserting operation in the retry operation.

It should be noted that according to the second method, when the left and right lower tool retention members 64L and 64R are moved forward, the left and right lower tool change units 50L and 50R move freely in the left-right direction. Therefore, after moving forward the left and right lower tool retention members 64L and 64R, the control device 100 may move the left and right lower tool change units 50L and 50R by the driving force of the driving mechanisms so as to correct an error between a current position and a target position. Alternatively, the control device 100 may set the current position when the left and right lower tool retention members 64L and 64R are moved forward as a final target position.

Further, the first and second methods described above may be applied not only to the first and second retry operations, but also to the control of the servo motor 52 of the right lower tool change unit 50R in the initial operation.

Second Embodiment

The bending system 10 according to a second embodiment will be described below. A point in which the bending system 10 according to the second embodiment is different from the bending system according to the first embodiment is the procedure of the gathering operation. The bending system 10 according to the second embodiment will be described below, with a focus on the difference from the bending system 10 according to the first embodiment.

FIGS. 8A to 8D and FIGS. 9A to 9D are diagrams showing a procedure of the gathering operation according to the second embodiment. The gathering operation according to the second embodiment will be described below with reference to FIGS. 8A to 8D and FIGS. 9A to 9D. The operations of FIGS. 8A to 8C correspond to the operations of FIGS. 3A to 3C.

Figure 8A:
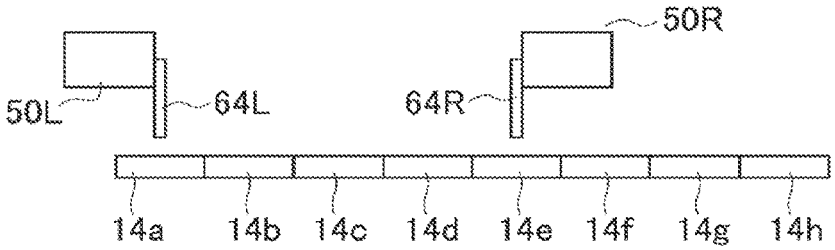
FIG. 8A is a diagram showing a part of a procedure of a gathering operation according to a second embodiment.
Figure 8B:
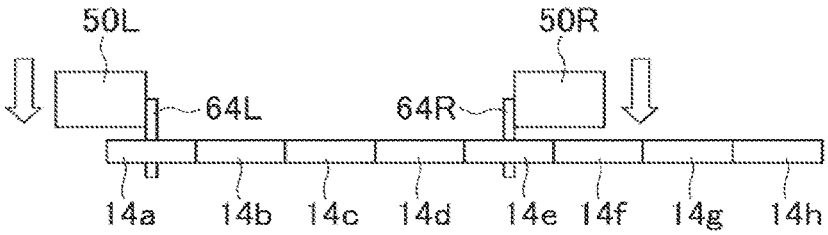
FIG. 8B is a diagram showing a part of the procedure of the gathering operation according to the second embodiment.
Figure 8C:
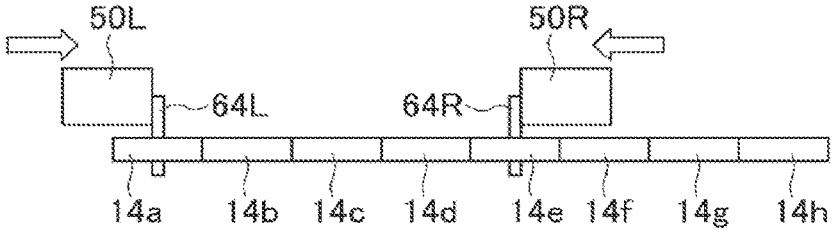
FIG. 8C is a diagram showing a part of the procedure of the gathering operation according to the second embodiment.
Figure 8D:
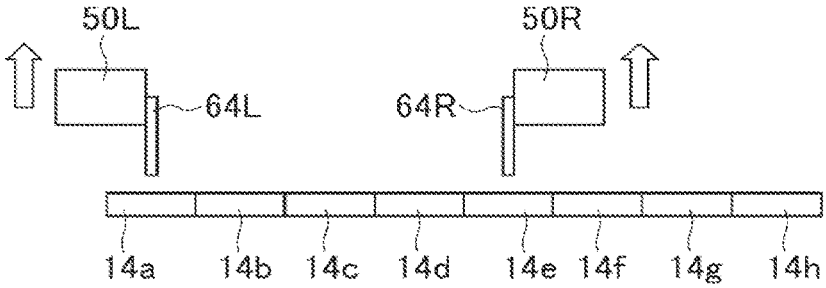
FIG. 8D is a diagram showing a part of the procedure of the gathering operation according to the second embodiment.

When the execution operation for the first target lower tool 14*e* is completed, as shown in FIG. 8D, the control device 100 moves backward the left and right lower tool retention members 64L and 64R, respectively, so as to pull out the left and right lower tool retention members 64L and 64R from the insertion holes 141 of the reference lower tool 14*a* and the target lower tool 14*e*, respectively.

Figure 9A:
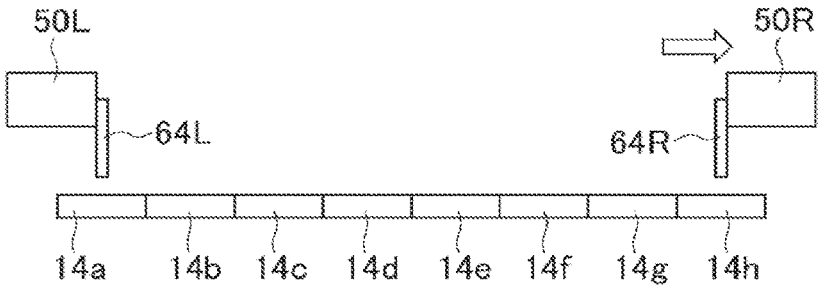
FIG. 9A is a diagram showing a part of the procedure of the gathering operation according to the second embodiment.

As shown in FIG. 9A, the control device 100 moves the right lower tool change unit 50R in the left-right direction so as to align the right lower tool change unit 50R with the second target lower tool 14*h* (alignment operation).

Figure 9B:
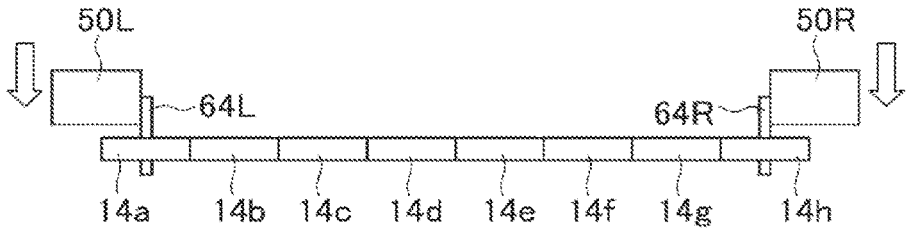
FIG. 9B is a diagram showing a part of the procedure of the gathering operation according to the second embodiment.

As shown in FIG. 9B, the control device 100 moves forward the left and right lower tool retention members 64L and 64R, respectively, so as to insert the left and right lower tool retention members 64L and 64R into the insertion holes 141 of the reference lower tool 14*a* and the target lower tool 14*h*, respectively (inserting operation).

Figure 9C:
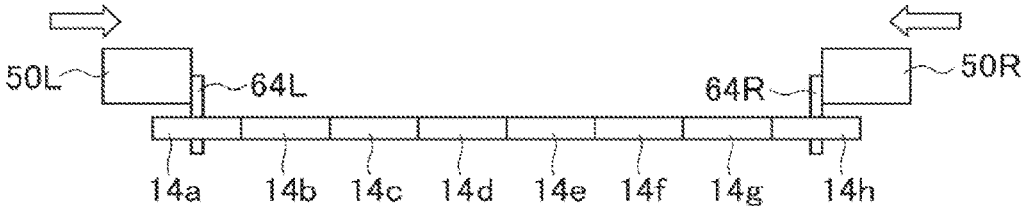
FIG. 9C is a diagram showing a part of the procedure of the gathering operation according to the second embodiment.

As shown in FIG. 9C, the control device 100 moves the left lower tool change unit 50L and the right lower tool change unit 50R along the left-right direction so as to come close with each other so that the seven lower tools 14*a* to 14*h* from the reference lower tool 14*a* to the target lower tool 14*h* are gathered in the center (execution operation).

Figure 9D:
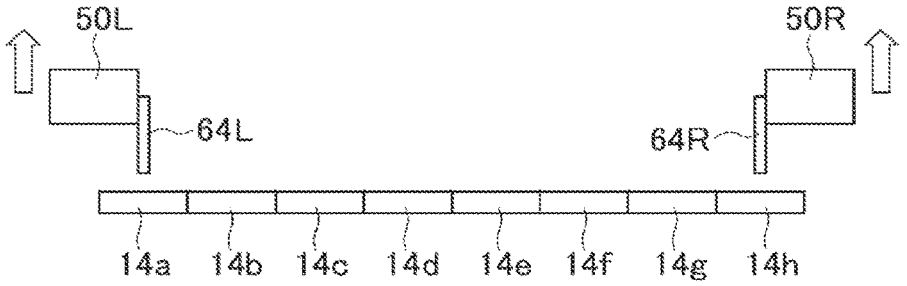
FIG. 9D is a diagram showing a part of the procedure of the gathering operation according to the second embodiment.

Finally, as shown in FIG. 9D, the control device 100 moves backward the left and right lower tool retention members 64L and 64R so as to pull out the left and right lower tool retention members 64L and 64R from the insertion holes 141 of the reference lower tool 14*a* and the target lower tool 14*h*, respectively.

As described above, by performing the gathering operation, the seven lower tools 14*a* to 14*h* can be arranged at the desired positions of the lower tool holder 30 in a state in which there are no gaps between the lower tools.

In this manner, according to the present embodiment, when the right lower tool retention member 64R is inserted into the target lower tool 14*h*, a restrained state of the reference lower tool with the left lower tool retention member 64L is temporarily released so that the left and right lower tool retention members 64L and 64R are simultaneously inserted into the reference lower tool 14*a* and the target lower tool 14*h*, respectively.

According to this operation, since the restraint operation to the reference lower tool 14*a* is temporarily released, the margin is generated for the reference lower tool 14*a* to slightly move toward the left. As a result, the reference lower tool 14*a* to the target lower tool 14*h* can slightly move to the left as a whole, and the position of the target lower tool 14*h* is moved. As a result, the right lower tool retention member 64R can be inserted into the target lower tool 14*h*. Therefore, the gathering operation can be continued without generating the alarm due to the insertion failure. As a result, the tool arrangement with high positional accuracy can be realized.

It should be noted that in the first and second embodiments described above, the left and right lower tool change units 50L and 50R and the left and right upper tool change units 74L and 74R are exemplified as the first and second moving bodies, respectively. However, the first and second moving bodies are not limited to these. Further, in the first and second embodiments described above, the left and right lower tool change units 50L and 50R and the left and right upper tool change units 74L and 74R are provided on rear surface sides of the lower table 24 and the upper table 26, respectively. However, the left and right lower tool change units 50L and 50R and the left and right upper tool change units 74L and 74R may be provided on front surface sides of the lower table 24 and the upper table 26, respectively.

As described above, the embodiments of the present disclosure have been described, but the statements and drawings forming part of this disclosure should not be understood to limit the embodiments. From this disclosure, various alternative embodiments, examples, and operational techniques will become apparent to those skilled in the art.

The disclosure of the present application relates to the subject matters described in Japanese Patent Application No. 2021-072018 filed on Apr. 21, 2021 and Japanese Patent Application No. 2022-65127 filed on Apr. 11, 2022. The entire disclosures thereof are hereby incorporated by reference.

The invention claimed is:

1. A bending system comprising:

a press brake in which a plurality of tools is arranged along a left-right direction in a tool holder provided to a table;

a first moving body including a first tool retention member and a second moving body including a second tool retention member capable of being inserted into and removed from an insertion hole provided to a target tool of the plurality of tools by moving forward and moving backward along a front-back direction, and provided on a rear surface side or a front surface side of the table so as to be movable in the left-right direction; and a control device configured to control each of the first and second moving bodies so as to perform a gathering operation of gathering the plurality of tools so that there are no gaps between the plurality of tools, wherein the gathering operation includes:

a restraint operation of moving forward the first tool retention member of the first moving body so as to restrain a reference tool positioned at one end of the plurality of tools with the first tool retention member;

an inserting operation of moving forward the second tool retention member of the second moving body so as to insert the second tool retention member into the insertion hole of the target tool selected from among remaining tools, which exclude the reference tool, of the plurality of tools; and an execution operation of moving the first and second moving bodies along the left-right direction so as to come close to each other so that tools of the plurality of tools, including the reference tool and the target tool, are gathered, and a retry operation, performed by the control device when a failure of the inserting operation is determined, of moving the second tool retention member forward to insert the second tool retention member into the insertion hole of the target tool after moving the first tool retention member backward to release the restraint operation of the reference tool.

2. The bending system according to claim 1, wherein the gathering operation includes an operation of selecting a new target tool from among the remaining tools of the plurality of tools, while the restraint operation is being continued, so as to repeatedly perform the inserting operation and the execution operation.

3. The bending system according to claim 1, wherein the retry operation includes a first retry operation of moving forward the first and second tool retention members, respectively, so as to insert the second tool retention member into the insertion hole of the target tool while the reference tool is being restrained with the first tool retention member.

4. The bending system according to claim 1, wherein the retry operation includes a second retry operation of moving forward the second tool retention member so as to insert the second tool retention member into the insertion hole of the target tool, and then moving forward the first tool retention member so as to restrain the reference tool with the first tool retention member.

5. The bending system according to claim 3, wherein the retry operation further includes a second retry operation of moving forward the second tool retention member so as to insert the second tool retention member into the insertion hole of the target tool, and then moving forward the first tool retention member so as to restrain the reference tool with the first tool retention member, and the control device executes the first retry operation, and performs the second retry operation when a failure of the first retry operation is determined.

6. The bending system according to claim 1, wherein the control device performs, when the failure of the inserting operation is determined, an initial operation of moving forward the second tool retention member to insert the second tool retention member into the insertion hole of the target tool after moving the second tool retention member backward while the restraint operation is being continued, and performs the retry operation when a failure of the initial operation is determined.

7. The bending system according to claim 1, wherein the first moving body and the second moving body are moved in the left-right direction by a predetermined amount when the first tool retention member and the second tool retention member are moved forward in the retry operation.

8. The bending system according to claim 7, wherein the control device controls a driving mechanism configured to drive the first moving body and the second moving body in the left-right direction so as to move the first moving body and the second moving body by the predetermined amount by way of a driving force of the driving mechanism.

9. The bending system according to claim 7, wherein the control device controls a driving mechanism configured to drive the first moving body and the second moving body in the left-right direction so as to release a braking force that restricts movements in the left-right direction of the first moving body and the second moving body so that the first moving body and the second moving body are moved by the predetermined amount by way of external forces received by the first tool retention member and the second tool retention member from the insertion holes.

10. The bending system according to claim 6, wherein the second moving body is moved in the left-right direction by a predetermined amount when the second tool retention member is moved forward in the initial operation.

11. The bending system according to claim 10, wherein the control device controls a driving mechanism configured to drive the second moving body in the left-right direction so as to move the second moving body by the predetermined amount by way of a driving force of the driving mechanism.

12. The bending system according to claim 10, wherein the control device controls a driving mechanism configured to drive the second moving body in the left-right direction so as to release a braking force that restricts a movement in the left-right direction of the second moving body so that the second moving body is moved by the predetermined amount by way of an external force received by the second tool retention member from the insertion hole.

13. A method of arranging tools in a press brake, comprising:

providing a press brake including a plurality of tools, a first moving body having a first tool retention member, a second moving body having a second tool retention member, wherein the first moving body and the second moving body are provided to a rear surface side or a front surface side of a table of the press brake, controlling, using a control device, movement of the first moving body and the second moving body in a left-right direction to arrange the plurality of tools along the left-right direction in a tool holder provided to the table, wherein performing, using the control device, a gathering operation of gathering the plurality of tools so that there are no gaps between the plurality of tools arranged in the tool holder; wherein the gathering operation includes:

a restraint operation of moving the first tool retention member of the first moving body forward along a front-back direction so as to restrain a reference tool of the plurality of tools positioned at one end of the plurality of tools with the first tool retention member;

an inserting operation of moving the second tool retention member of the second moving body forward along the front-back direction so as to insert the second tool retention member into an insertion hole of a target tool selected from among remaining tools of the plurality of tools, which exclude the reference tool; and an execution operation of moving the first and second moving bodies along the left-right direction so as to come close to each other so that tools of the plurality of tools, from the reference tool to the target tool, are gathered, and a retry operation, performed by the control device when a failure of the inserting operation is determined, of moving the second tool retention member forward to insert the second tool retention member into the insertion hole of the target tool after moving the first tool retention member backward to release the restraint operation.

* * * * *